US006252151B1

(12) United States Patent
Liao

(10) Patent No.: US 6,252,151 B1
(45) Date of Patent: Jun. 26, 2001

(54) ADJUSTABLE CLAMP ASSEMBLY FOR FIXING PEDAL DECK TO DRUM COUNTERHOOP

(76) Inventor: Tsun-Chi Liao, No. 14, Chun-Kung Rd., Pei-Tun Dist., Taichung City (TW)

( * ) Notice: Subject to any disclaimer, the term of this patent is extended or adjusted under 35 U.S.C. 154(b) by 0 days.

(21) Appl. No.: 09/571,284

(22) Filed: May 16, 2000

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 886,471 | * | 5/1908 | Britton | 84/422.1 |
| 2,784,635 | * | 3/1957 | Troppe | 84/422.1 |
| 5,185,489 | * | 2/1993 | Hoshino | 84/422.1 |

* cited by examiner

*Primary Examiner*—Shih-Yung Hsieh
(74) *Attorney, Agent, or Firm*—Bacon & Thomas, PLLC

(57) ABSTRACT

An adjustable clamp assembly for fixing pedal deck to drum counterhoop comprises a clamping seat disposed at a front end of a pedal deck; a clamping mechanism arranged on the clamping seat; the clamping mechanism composed of a stationary seat, an upper jaw, and an adjustment stud; the stationary seat being fixed on the clamping seat by locking a first transom and the upper jaw with bolts; a tapped through hole formed in center of the first transon for pivotally fixing the adjustment stud; a second transom having a through hole being locked at center position of the upper jaw; a clamping portion disposed on a bottom face at a front end of the upper jaw; a tail end of the upper jaw being pivotally fixed in the stationary seat; one end of the adjustment stud being wing-shaped; a pivotally fixing portion with a relative shorter diameter being disposed at a position adjacent to a tail end of the adjustment stud; a nut being pivotally fixed at a tail end of the pivotally fixing portion, and the adjustment stud being penetrating through the first and the second transon.

6 Claims, 5 Drawing Sheets

ADJUSTABLE CLAMP ASSEMBLY FOR FIXING PEDAL DECK TO DRUM COUNTERHOOP

BACKGROUND OF THE INVENTION

This invention relates generally to clamp assembly, more particularly, it relates to an adjustable clamp assembly, which can be adjusted easily according to personal custom, for fixing a pedal deck to a drum counterhoop.

It is disputable that music is one of indispensable mental foods in daily life nowadays, wherein a bass drum plays an important role for providing distinct rhythm of the music.

The bass drum is usually percussed by a beater driven by an automatic restorable pedal. In a conventional pedal structure, one end of the pedal is pivotally fixed at a pedal deck, and the other end linked with a beater is left open, wherein a clamp mechanism is arranged at the front end of the pedal deck for clamping the latter at a drum counterhoop (shown in FIG. 1). When a user is beating the drum head, the drum head will quake the clamping mechanism to get loosened gradually, or, in the case when adjustment of the clamp mechanism is desired, the user has to stoop and poke his hand into the limited space under the pedal for adjusting an adjustment bolt that makes him risk an accidental injury to his finger because of momentary carelessness.

In view of abovesaid defects, this invention is proposed to build a clamp mechanism on a clamping seat, including a stationary seat, an upper jaw, and an adjustment stud for adjusting intimacy between a pedal deck and a drum counterhoop without risking any accidental injury to a user's hand or fingers.

SUMMARY OF THE INVENTION

The primary object of this invention is to provide an adjustable clamp assembly for fixing a pedal deck to a drum counterhoop, which, the clamp assembly, can be adjusted easily for controlling intimacy between the pedal deck and the drum counterhoop.

In order to realize abovesaid object, the clamp assembly comprises a clamping seat disposed at a front end of a pedal deck; a clamping mechanism arranged on the clamping seat; the clamping mechanism composed of a stationary seat, an upper jaw, and an adjustment stud; the stationary seat being fixed on the clamping seat by locking a first transom and the upper jaw with bolts; a tapped through hole formed in ceter of the first transom for pivotally fixing the adjustment stud; a second transom having a through hole being locked at center position of the upper jaw; a clamping portion disposed on a bottom face at a front end of the upper tail; a tail end of the upper jaw being pivotally fixed in the stationary seat; one end of the adjustment stud being wing-shaped; a pivotally fixing portion with a relative shorter diameter being disposed at a position adjacent to a tail end of the adjustment stud; a nut being pivotally fixed at a tail end of the pivotally fixing portion, and the adjustment stud being penetrating through the first and the second transom.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
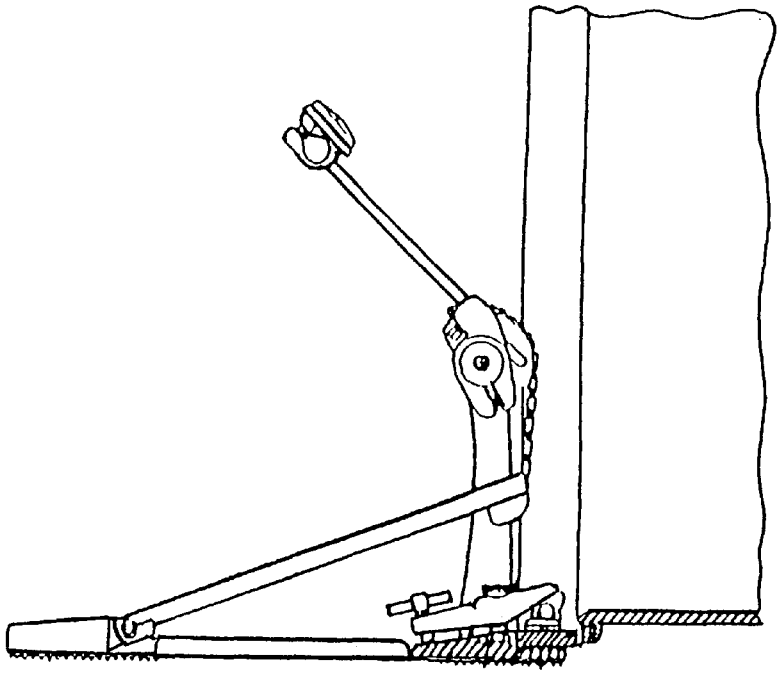
Fig.1 PRIOR ART
FIG. 1 is a plan view of a conventional pedal deck of bass drum.
Figure 2:
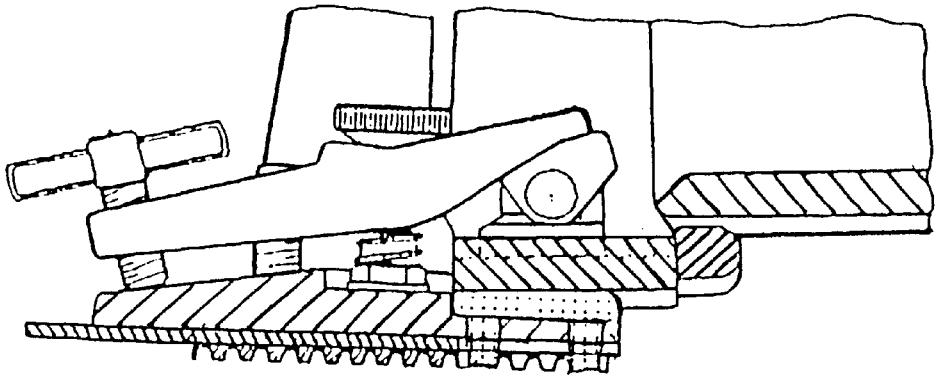
Fig.2 PRIOR ART
FIG. 2 is a partially enlarged view of the conventional pedal deck.

An adjustable clamp assembly of this invention for fixing a pedal deck to a drum counterhoop mainly comprises a pedal deck 10 with a bass beater for pivotally fixing a pedal 11 at one end while the other end is left open. A clamping seat 20 is arranged at the front end of the pedal deck 10, wherein a recess 21 is formed in center of a front edge of the clamping seat 20; two protruding walls 22 are arranged at a rear edge of the recess 21, wherein a store space 23 is formed between those two protruding walls 22; a plurality of fixing holes 24 is located at one side of the clamping seat 20; and, a stationary seat 30, an upper jaw 40, and an adjustment stud 50 are joined together to form a clamping mechanism.

Further, a plurality of tapped holes 31 is perforated in a bottom face of the stationary seat 30 at positions corresponding to the fixing holes 24 of the clamping seat 20 for locking the stationary seat 30 onto the clamping seat 20. In each of two lateral walls of the stationary seat 30, a first and a second through hole 32, 33 are formed respectively, and a first transom 34 is fixed striding the first through holes 32, wherein a tapped through hole 35 is disposed in center of the first transom 34.

The upper jaw 40 is bent slightly to cock center portion upwardly, wherein a tapped through hole 41 is formed in center of each of two arms of the upper jaw 40 individually for fixing a second transom 42 with bolts; a through hole 43 is disposed in center of the second transom 42; a serrate clamping portion 44 is formed in bottom face of a front end of the upper jaw 40 for clamping at the drum counterhoop; and, a through hole 45 is provided in a tail end of the upper jaw 40 for pivotally fixing the upper jaw 40 at the stationary seat 30 by penetrating bolts through the second through hole 33 of the stationary seat 30.

Moreover, one end of the adjustment stud 50 is wing-shaped for easy swiveling, wherein a pivotally fixing portion 51 with a relatively shorter diameter is arranged at a position adjacent to a tail end of the adjustment stud 50; and, the tail end of the adjustment stud 50 is threaded for locking a nut 52.

Figure 3:
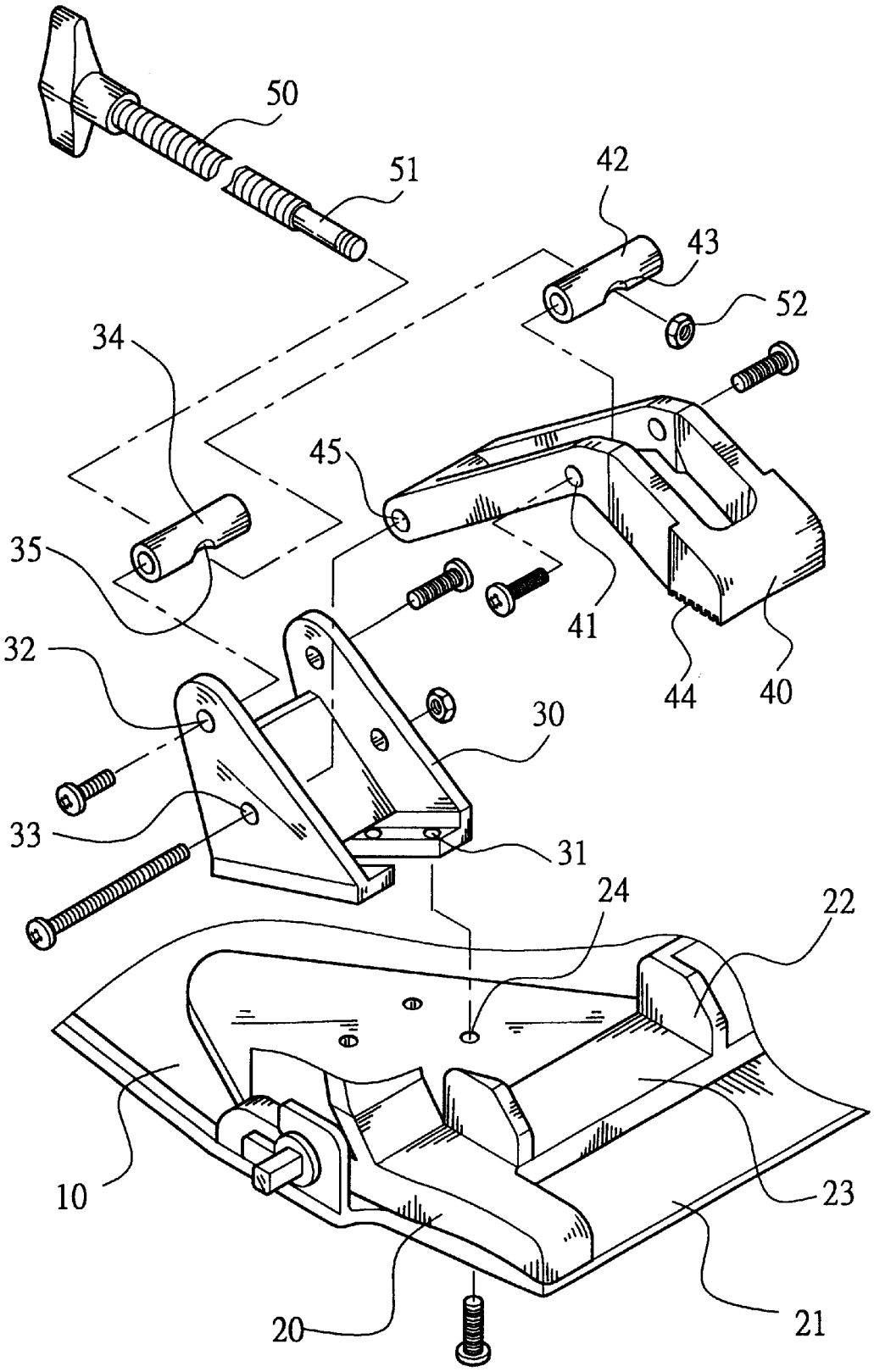
FIG. 3 is an exploded view of this invention in three dimensions.
Figure 4:
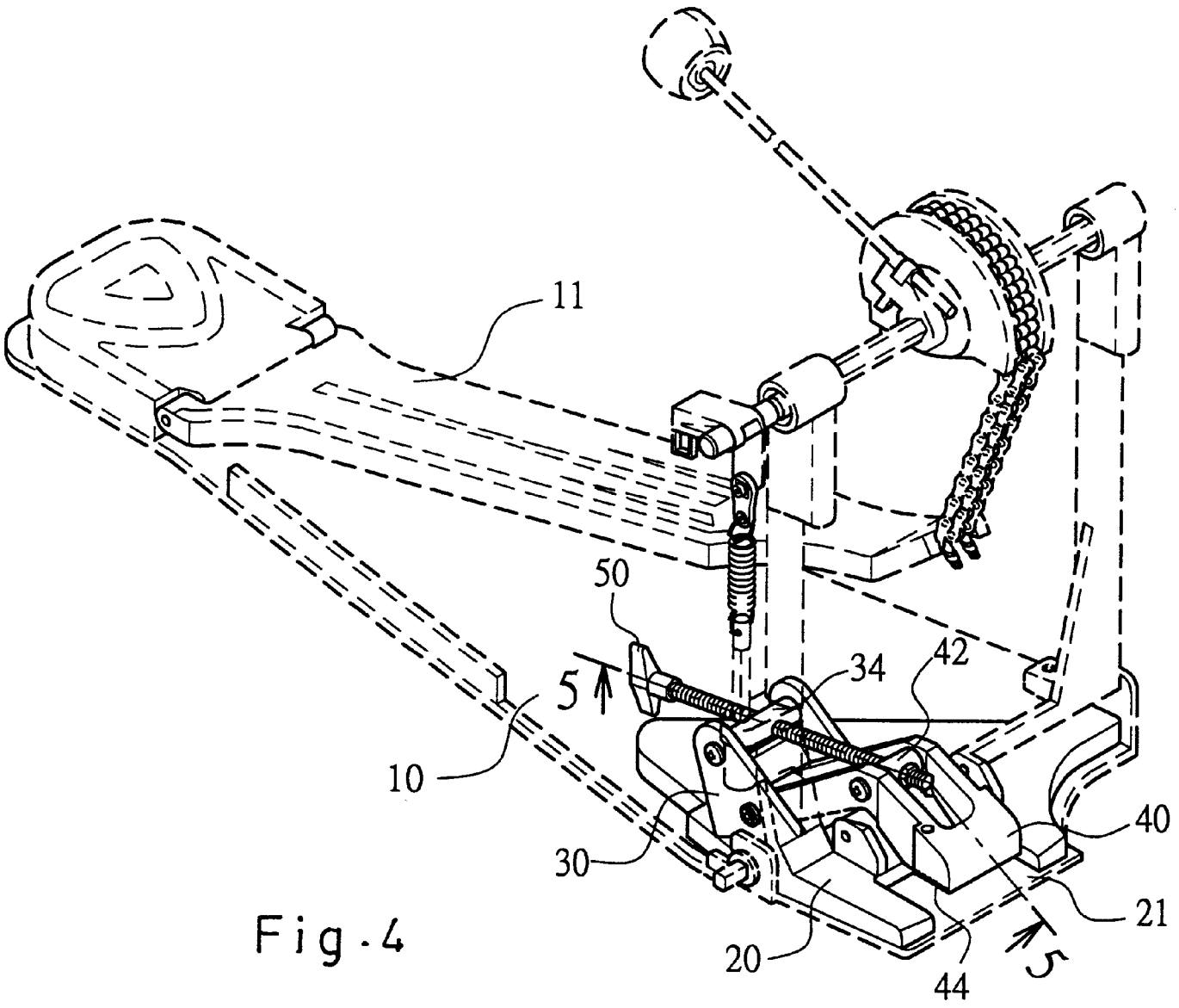
FIG. 4 is an assembled elevational view of this invention.
Figure 5A:
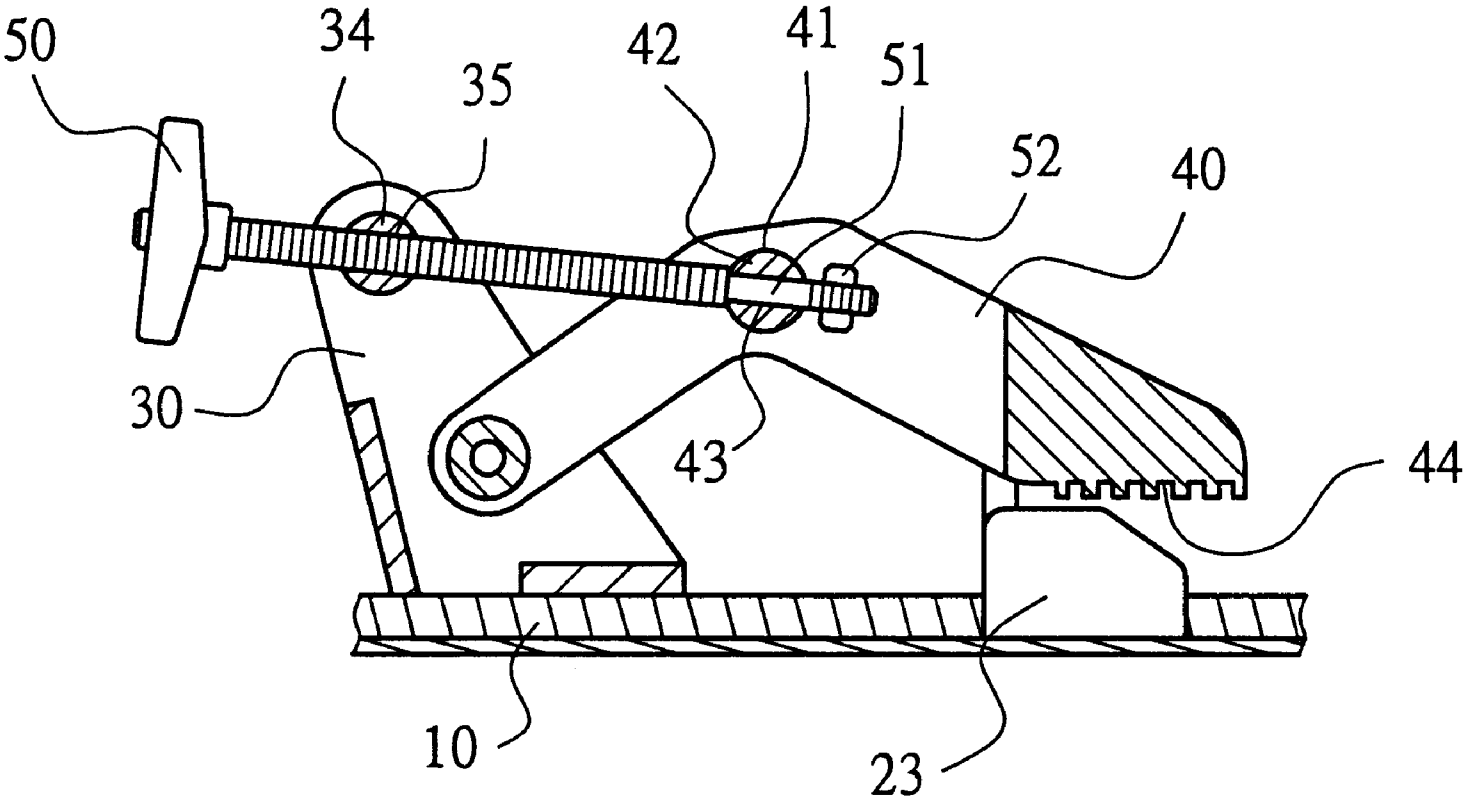
FIG. 5A is a cutaway sectional view taken along line 5—5 in FIG. 4.
Figure 5B:
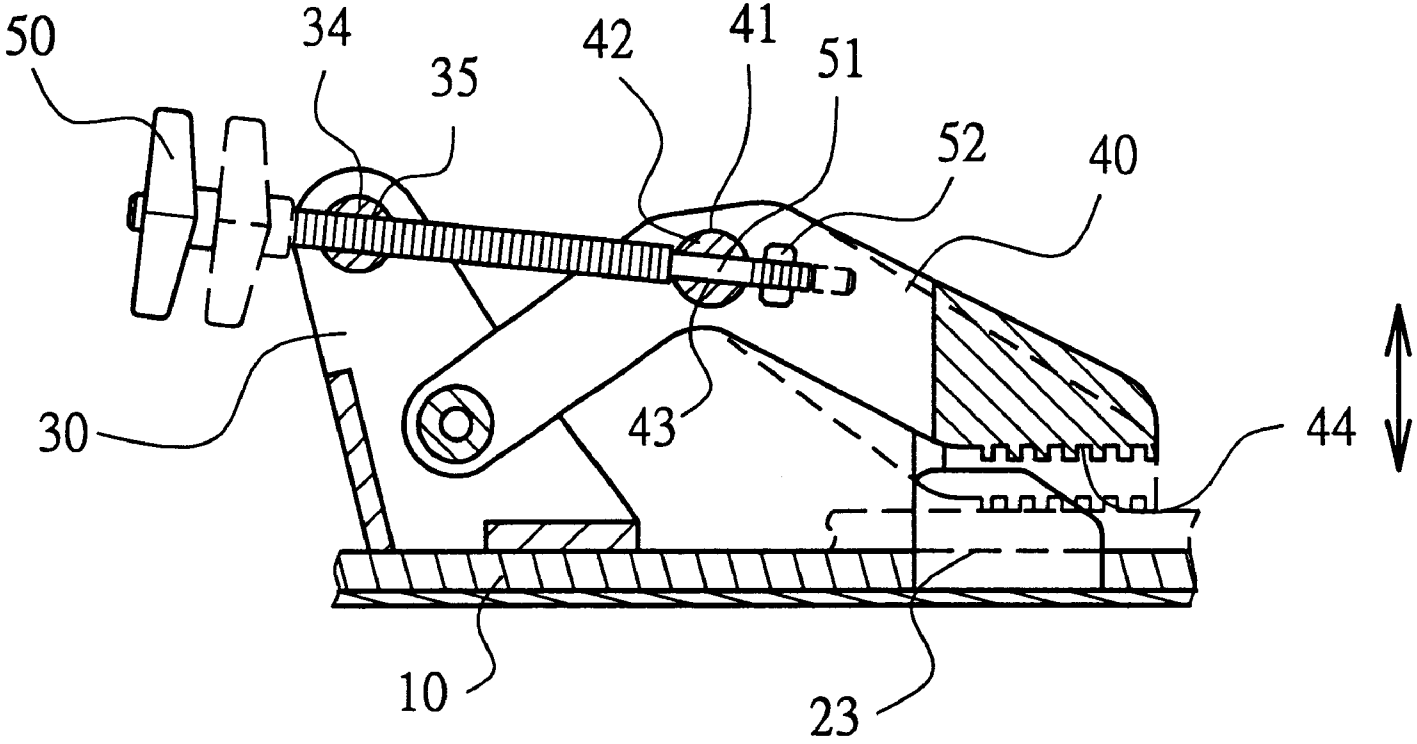
FIG. 5B illustrates action in FIG. 5A.

When using the components shown in FIG. 3 to build a pedal beater of a bass drum shown in FIG. 4, the assembly procedure is firstly to have bolts penetrated through the fixing holes 24 of the clamping seat 20 and the tapped holes 31 of the stationary seat 30 to lock the stationary seat 30 onto the clamping seat 20; then, penetrate the second through hole 33 of the stationary seat 30 and the through hole 45 of the upper jaw 40 with bolts in order to pivotally fix the upper jaw 40 on the stationary seat 30; lock each the first transom 34 and the second transom 42 to the stationary seat 30 and the upper jaw 40 respectively; penetrate the adjustment stud 50 through the tapped through hole 35 of the first transom 34 and extend it to the through hole 43 of the second transom 42 to have the adjustment stud 50 screw-fixed in the tapped through hole 35 of the first transom 34 and have the pivotally fixing portion 51 screw-fixed in the through hole 43 of the second transom 42; also, have the nut 52 screw-fixed at the tail end of the adjustment stud 50 for preventing the adjustment stud 50 from escaping; and, rest the upper jaw 40 in the store space 23 of the clamping seat 20.

Because the adjustment stud 50, the first transom 34, together with the second transom 42 form a lever, and the second transom 42, the upper jaw 40, together with the stationary seat 30 form another lever, hence, in clamping this invention to the drum counterhoop, a user is supposed to screw the adjustment stud 50 to push the second transom 42, the serrate clamping portion 44 of the upper jaw 40 is in turn pushed downwards to descend to the store space 23 of the clamping seat 20 to cooperate with the clamping portion 44 of the upper jaw 40 and the clamping seat 20 for engaging with the drum counterhoop.

On the contrary, the upper jaw 40 can be easily detached from the drum counterhoop by a reverse operation of the adjustment stud 50, namely, swiveling reversely to loosen the adjustment stud 50 to pull the second transom 42 approaching the first transom 34 to have the angle of elevation of the upper jaw 40 increased.

According to the abovesaid, the merits of this invention may be summarized as the following:

1. As the pedal 11 does not shield the adjustment stud 50, a user can adjust the latter easily without worrying his finger being accidentally pinched.
2. Two levers are available for easy clamping adjustment or detachment.

Although, this invention has been described in terms of preferred embodiments, it is apparent that numerous variations and modifications may be made without departing from the true spirit and scope thereof, as set forth in the following claims.

What is claimed is:

1. An adjustable clamp assembly for fixing pedal deck to drum counterhoop, comprising a clamping seat disposed at a front end of a pedal deck, and a clamp mechanism arranged on the clamping seat, wherein:

the clamp mechanism further comprises a stationary seat, an upper jaw, and an adjustment stud;

the stationary seat is fixed on the clamping seat, a plurality of bolts is used to lock a first transom and the upper jaw, a tapped through hole is formed in center of the first transom for pivotally fixing the adjustment stud;

a plurality of bolts is used to fix a second transom is center of the upper jaw; a through hole is perforated in center of the second transom; a clamping portion is formed in a bottom face of a front end of the upper jaw for clamping at a drum counterhoop; a tail end of the upper jaw is pivotally fixed in the stationary seat; and a pivotally fixing portion with a relatively shorter diameter is arranged at a position adjacent to a tail end of the adjustment stud; the tail end of the adjustment stud is threaded for locking a nut; the adjustment stud penetrates the first and the second transom.

2. The adjustable clamp assembly according to claim 1, wherein a recess is formed in center of a front edge of the clamping seat; two protruding walls are arranged at a rear edge of the recess, wherein a store space is formed between those two protruding walls.

3. The adjustable clamp assembly according to claim 1, wherein a first and a second through hole are formed respectively in each of two lateral walls of the stationary seat, and the first transom is fixed striding the first through holes with a plurality of bolts.

4. The adjustable clamp assembly according to claim 1, wherein the upper jaw is bent slightly to cock center portion upwardly, wherein a tapped through hole is formed in center of each of two arms of the upper jaw individually for fixing a second transom.

5. The adjustable clamp assembly according to claim 1, wherein a tail end of the upper jaw is pivotally fixed in the stationary seat by forming a through hole at the tail end of the upper jaw, and using bolts to penetrate and fix the upper jaw at a second through hole of the stationary seat.

6. The adjustable clamp assembly according to claim 1, wherein the clamping portion is serrated in straight bars and formed at the bottom face of the front end of the upper jaw for clamping at the drum counterhoop.

* * * * *